US008702530B2

(12) United States Patent
Slaughter et al.

(10) Patent No.: US 8,702,530 B2
(45) Date of Patent: Apr. 22, 2014

(54) DEVICE FOR CHANGING MASS CHARACTERISTICS OF A GOLF CLUB

(75) Inventors: Byron Cole Slaughter, Granbury, TX (US); Jeremy N. Snyder, Benbrook, TX (US); Michael G. Taylor, Granbury, TX (US)

(73) Assignee: NIKE, Inc., Beaverton, OR (US)

( * ) Notice: Subject to any disclaimer, the term of this patent is extended or adjusted under 35 U.S.C. 154(b) by 450 days.

(21) Appl. No.: 12/907,306

(22) Filed: Oct. 19, 2010

(65) Prior Publication Data

US 2012/0094780 A1 Apr. 19, 2012

(51) Int. Cl.

*A63B 53/10* (2006.01)
*A63B 53/12* (2006.01)
*A63B 53/04* (2006.01)

(52) U.S. Cl.

USPC ..... 473/297; 473/333

(58) Field of Classification Search

USPC ..... 473/226, 292, 282, 316, 318, 297
See application file for complete search history.

(56) References Cited

U.S. PATENT DOCUMENTS

| | | | | | |
|---|---|---|---|---|---|
| 2,051,083 | A | * | 8/1936 | Hart | 473/297 |
| 2,098,445 | A | | 11/1937 | Wettlaufer | |
| 2,592,013 | A | | 4/1952 | Curley | |
| 2,644,890 | A | * | 7/1953 | Ramona | 250/462.1 |
| 3,037,775 | A | * | 6/1962 | Busch | 473/326 |
| 3,589,731 | A | | 6/1971 | Chancellor, Jr. | |
| 3,951,413 | A | | 4/1976 | Bilyeu | |
| 3,993,314 | A | * | 11/1976 | Harrington et al. | 473/326 |
| 4,461,481 | A | | 7/1984 | Kim | |
| 4,541,631 | A | * | 9/1985 | Sasse | 473/297 |
| 4,655,458 | A | | 4/1987 | Lewandowski | |
| 4,957,468 | A | * | 9/1990 | Otsuka et al. | 464/27 |
| 4,969,921 | A | * | 11/1990 | Silvera | 473/234 |
| 5,082,279 | A | * | 1/1992 | Hull et al. | 473/242 |
| 5,195,747 | A | | 3/1993 | Choy | |
| 5,366,222 | A | | 11/1994 | Lee | |
| 5,411,255 | A | * | 5/1995 | Kurashima et al. | 473/332 |
| 5,478,075 | A | * | 12/1995 | Saia et al. | 473/238 |
| 5,575,722 | A | * | 11/1996 | Saia et al. | 473/300 |
| 5,580,321 | A | * | 12/1996 | Rennhack | 473/234 |
| 5,590,875 | A | * | 1/1997 | Young | 473/457 |
| 5,628,697 | A | | 5/1997 | Gamble | |
| 5,632,691 | A | * | 5/1997 | Hannon et al. | 473/292 |
| 5,776,009 | A | | 7/1998 | McAtee | |
| 5,803,829 | A | * | 9/1998 | Hayashi | 473/326 |
| 6,296,576 | B1 | | 10/2001 | Capelli | |

(Continued)

FOREIGN PATENT DOCUMENTS

| | | | | |
|---|---|---|---|---|
| JP | 6-246022 | * | 9/1994 | |
| JP | 2000229139 A | * | 8/2000 | A63B 53/08 |

OTHER PUBLICATIONS

International Search Report and Written Opinion mailed Sep. 14, 2004 in PCT Application No. PCT/US2011/056090.

*Primary Examiner* — Stephen L. Blau
(74) *Attorney, Agent, or Firm* — Banner & Witcoff, Ltd.

(57) ABSTRACT

A device for changing the mass characteristics of a golf club may include a first movable mass. The device may also include a first movable mass guide configured to accommodate longitudinal travel of the first movable mass along the golf club shaft. The first movable mass guide may not extend beyond the distal end of the golf club shaft. The golf club head may include a second movable mass and a second movable mass guide that accommodates travel of the second movable mass.

7 Claims, 10 Drawing Sheets

(56) References Cited

U.S. PATENT DOCUMENTS

| | | | | |
|---|---|---|---|---|
| 6,302,813 | B1 * | 10/2001 | Sturgeon et al. | 473/564 |
| 6,575,854 | B1 * | 6/2003 | Yang et al. | 473/519 |
| 6,641,490 | B2 | 11/2003 | Ellemor | |
| 7,147,580 | B2 * | 12/2006 | Nutter et al. | 473/457 |
| 7,261,641 | B2 * | 8/2007 | Lindner | 473/297 |
| 7,481,716 | B1 * | 1/2009 | Johnson | 473/297 |
| 7,682,267 | B2 * | 3/2010 | Libonati | 473/457 |
| 7,699,718 | B2 * | 4/2010 | Lindner | 473/297 |
| 7,704,160 | B2 * | 4/2010 | Lindner | 473/297 |
| 7,704,161 | B2 * | 4/2010 | Lindner | 473/297 |
| 7,922,595 | B2 * | 4/2011 | Libonati | 473/224 |
| 8,177,658 | B1 * | 5/2012 | Johnson | 473/297 |
| 8,444,502 | B2 * | 5/2013 | Karube | 473/297 |
| 2003/0017884 | A1 * | 1/2003 | Masters et al. | 473/316 |
| 2004/0009824 | A1 * | 1/2004 | Shaw | 473/226 |
| 2005/0054459 | A1 * | 3/2005 | Oldenburg | 473/297 |
| 2005/0261079 | A1 * | 11/2005 | Qualizza | 473/316 |
| 2006/0054438 | A1 * | 3/2006 | Asaba et al. | 188/322.19 |
| 2010/0105498 | A1 * | 4/2010 | Johnson | 473/318 |
| 2010/0184526 | A1 * | 7/2010 | Park | 473/226 |

* cited by examiner

DEVICE FOR CHANGING MASS CHARACTERISTICS OF A GOLF CLUB

TECHNICAL FIELD

The present disclosure relates to the mass characteristics of golf clubs. Particular example aspects of this disclosure relate to golf clubs having one or more movable masses, to golf club shafts having one or more movable masses, and to golf club heads having one or more movable masses.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf celebrities, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. Being the sole instrument that sets a golf ball in motion during play, golf clubs have been the subject of much technological research and advancement in recent years. A wide range of different golf club models now are available, with the market seeing dramatic changes and improvements in golf club head designs, shafts, and grips in recent years. Even further, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

For a given club head mass, the distance a golf ball travels when struck by a golf club is determined in large part by the speed of the club head at the moment of impact with the golf ball. This is especially the case for drivers. Higher club head speeds at the moment of impact result in a greater energy being transmitted to the golf ball, with corresponding greater distances being achieved. The ultimate speed of the club head may be affected by factors such as the drag developed by the club head during the entirety of the swing. Thus, various golf club heads for drivers have been introduced to improve the aerodynamic characteristics of the golf club, thereby reducing the drag.

Additionally, the speed developed by the club head at the moment of impact may be affected by factors such as the mass characteristics of the club. For example, golf clubs with greater moments-of-inertia require more energy to swing than clubs with lower moments-of-inertia. Thus, clubs with lower moments-of-inertia may achieve a greater ultimate club head speed compared to clubs with higher moments-of-inertia. However, as moments-of-inertia reflect the mass distribution of the club, with masses farthest from the point of rotation having the greatest affect, appreciably reducing the moment-of-inertia of a golf club would typically require that the mass of the golf club head be decreased. On the other hand, a reduction in the mass of the club head may be undesirable, as the amount of energy transferred from the club head to the golf ball is a function of the mass of the club head.

While the industry has made significant improvements to golf equipment in recent years, every player would like to improve the distance they are able to reliably hit the golf ball. Accordingly, there is room in the art for further advances in golf club technology.

SUMMARY OF THE DISCLOSURE

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Aspects of this disclosure relate to a device for changing the mass characteristics of a golf club. The device may include a movable mass and a movable mass guide provided on the golf club shaft. The movable mass guide may be configured to accommodate longitudinal travel of the movable mass along at least a portion of the golf club shaft, particularly during a downswing of the golf club.

According to certain aspects, the movable mass guide does not extend beyond the distal end of the golf club shaft. The movable mass guide may extend over a majority of the length of the golf club shaft. The movable mass guide may accommodate travel of the movable mass within the golf club shaft. Alternatively, the movable mass guide may accommodate travel of the movable mass external to the golf club shaft. Further, the movable mass guide may be configured as a conduit-type element, a track-type element and/or a flexible guide element. A stop may be provided at one or both ends of the movable mass guide. The stop may be configured to attenuate impact loads.

According to other aspects, the movable mass may be non-deformable. Alternatively, the movable mass may be deformable. Further, the movable mass may be flowable or non-flowable.

According to further aspects, a golf club, having a golf club shaft extending longitudinally from a proximal end to a distal end and a golf club head attached to the distal end of the golf club shaft, may include the device disclosed herein for changing the mass characteristics of a golf club.

According to even further aspects, the golf club head of the golf club may include a second movable mass and a movable mass guide that accommodates travel of the second movable mass. During a downswing of the golf club, the second movable mass may travel away from the shaft, for example from a heel of the club head toward a toe of the club head.

According to certain aspects, the second movable mass guide may be removably secured to the golf club head. Optionally, the second movable mass guide may include a stop configured to position the center-of-gravity of the second movable mass behind a desired point-of-contact of the golf club head with the golf ball.

According to certain other aspects, a golf club comprising a club shaft extending longitudinally from a proximal end to a distal end and a club head attached to the distal end of the club shaft, the club head including a ball striking face, a toe and a heel may be provided. The club head may include a club head movable mass and a club head movable mass guide configured for substantially linear movement of the club head movable mass toward the toe of the club head. According to some aspects, the club head movable mass may be non-flowable.

BRIEF DESCRIPTION OF THE DRAWINGS

The present invention is illustrated by way of example and not limited in the accompanying figures, in which like reference numerals indicate similar elements throughout, and in which.

Figures 1, 1A:
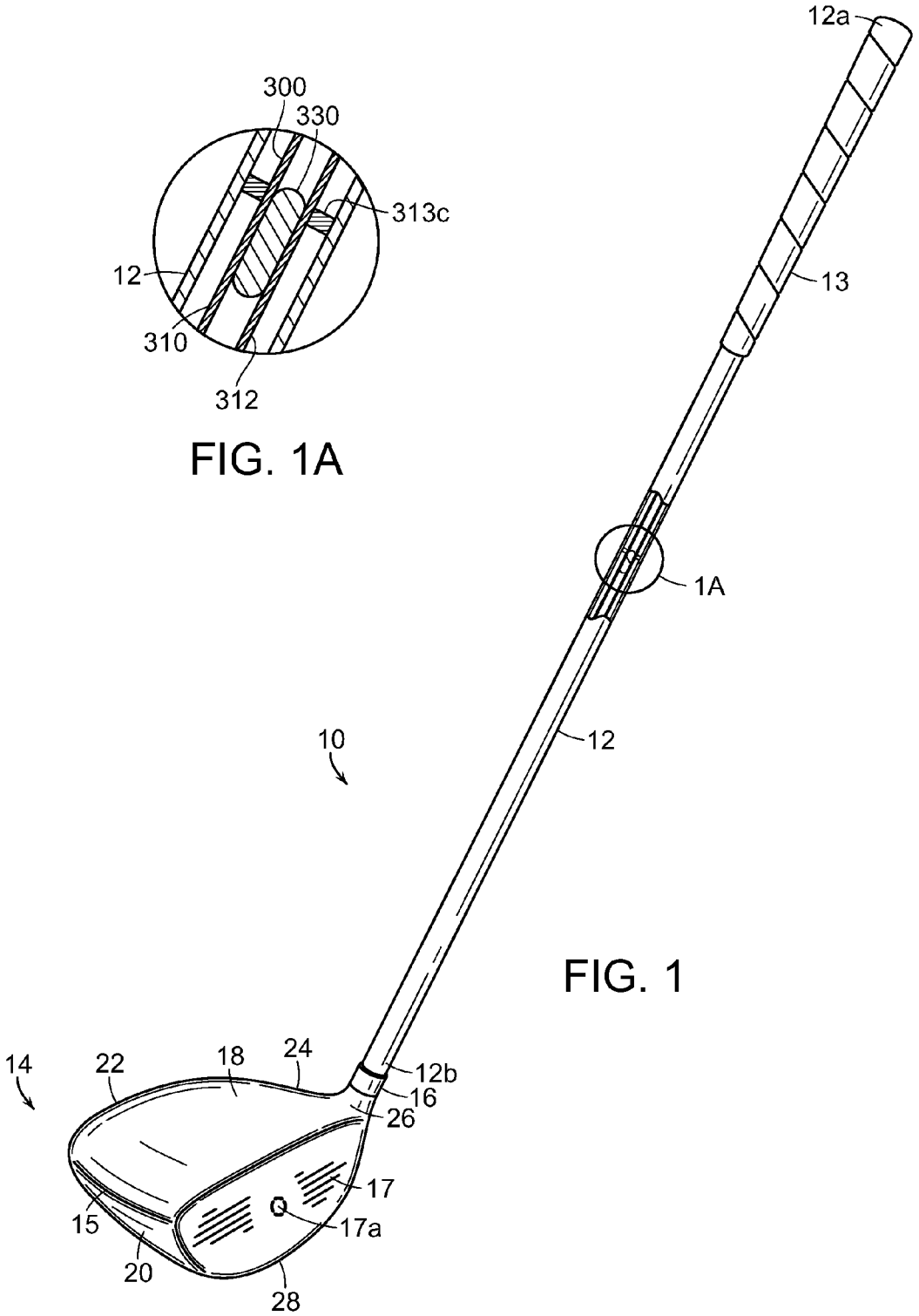
FIG. 1 generally illustrates a perspective view of a golf club structure according to at least some aspects of this disclosure.

The figures referred to above are not necessarily drawn to scale, should be understood to provide a representation of particular embodiments of the invention, and are merely conceptual in nature and illustrative of the principles involved. Some features of the golf club head depicted in the drawings may have been enlarged or distorted relative to others to facilitate explanation and understanding. The same reference numbers are used in the drawings for similar or identical components and features shown in various alternative embodiments. Golf club heads as disclosed herein would have configurations and components determined, in part, by the intended application and environment in which they are used.

DETAILED DESCRIPTION

The following description and the accompanying figures disclose features of golf clubs and golf club shaft having changing mass characteristics in accordance with examples of the present disclosure.

I. General Description of Example Golf Clubs, Golf Club Shaft Stiffening Devices and Methods in Accordance with this Disclosure As described above, all players would like to increase the distance that they can reliably hit a golf ball. Therefore, aspects of the disclosure are directed to golf clubs configured to aid a player in hitting the ball farther. Particular aspects of the disclosure are directed to increasing the speed at which the golf club head is traveling at the moment of impact with the golf ball. Other aspects of the disclosure are directed to controlling the moment of inertia of the golf club during the swing and at the moment of impact. Even further aspects may be directed at dynamically changing the flexure characteristics of a golf club shaft due to the shift in mass distribution on the shaft.

According to some aspects of the disclosure, golf clubs may be provided with a device for changing a mass characteristic of the golf clubs. The mass-characteristic-changing device may include one or more movable masses. Further, the mass-characteristic-changing device may include a moveable mass guide configured to guide the one or more movable masses as they move. The device may be located in and/or on the shaft of the golf club and/or in and/or on the head of the golf club.

According to some aspects of the disclosure, movement one or more of the movable masses may affect the mass characteristics of the golf club, including the moment-of-inertia (MOI) and the center-of-gravity (CG). The one or more movable masses may shift position during the downswing of the golf club. Thus, at the beginning of the downswing, the golf club may have a first set of moment-of-inertia characteristics and a first set of center-of-gravity characteristics. At the end of the downswing, or at the moment of impact, the golf club may have a second set of MOI characteristics and a second set of CG characteristics. During the course of the downswing, the MOI and the CG shift as the one or more movable masses moves.

According to some aspects of the disclosure, the change in the MOI and/or the CG characteristics may aid the player to achieve higher moment-of-impact speeds. Even further, the change in the MOI and/or the CG characteristics may aid the player to achieve more reliable shots.

According to certain aspects, the movable mass may be rigid or non-deformable. By way of non-limiting examples, a non-deformable movable mass may be formed as a lead pellet or other metallic slug. Alternatively, the movable mass may be formed as a deformable mass. According to certain aspects, the deformable movable mass may be flowable. By way of non-limiting example, a flowable movable mass may include an aggregate of particulate matter, such as grains of sand or polymer or glass beads, wherein the aggregate conforms to the shape of the member containing it. As another non-limiting example, a flowable movable mass may include a liquid, paste or gelatin. In the case of movable masses including an aggregate of particulate matter and/or including a liquid, etc., the mass may include a deformable member for containing the flowable matter. In such an instance, the movable mass, as a single entity, may best be characterized as deformable, but not flowable.

A movable mass guide may be used to guide or control the movement of the one or more movable masses. By way of a non-limiting example, the movable mass guide may include one or more slideway members, such as conduit-type elements, track-type elements, flexible guide elements, etc. Generally, the slideway members control the direction of movement of the movable mass. Elongated slideway members extend in a generally longitudinal direction and allow the moveable mass to move in this longitudinal direction. As one example, a conduit-type element may be configured as a continuous, enclosed, conduit. As another example, a conduit-type element may be configured as an open channel. Thus, a conduit-type element may, partially or entirely, enclose or extend around the periphery of the movable mass. Alternatively or additionally, the movable mass may move along a track element. The track element may include one or more rails, rods, etc., or other relatively stiff, elongated, guide elements. In general, a track-type element may be considered to be a linear, relatively two-dimensional, element having more limited contact with the movable mass that would a conduit-type element. A flexible guide element may include a tension element(s), such as wires, cables, strands etc. In general, the flexible guide elements are string-like tension elements. Each of the slideway members is configured to restrain lateral movement (to a greater or lesser degree) of the movable mass as the movable mass moves in the generally longitudinal direction.

The movable mass guide may also include control-type elements, such as stops, friction elements, catches and releases etc. Stops may include hard stops, such as relatively rigid walls or projections. Stops may also include soft stops, such as springs or elastomeric elements. Friction elements may be used to slow, but not necessarily entirely stop, the passage of the movable masses. In certain aspects, friction elements may be formed as constrictions in the movable mass guides. Catches may be used to stop or temporarily restrain the travel of the movable masses at certain locations. In certain aspects, catches may also be formed as constrictions in the movable mass guides. Releases may be used to allow the movable masses to be released from the catches. In general, the control-type elements control the rate of movement of the movable mass—either slowing it down, stopping it completely, locking it in place, or releasing it.

According to some aspects of the disclosure, the one or more movable masses may move over a certain distance over a certain time period. By way of non-limiting example, the time period associated with the movement of a movable mass may substantially correspond to the time period of the downswing. According to other aspects, the time period associated with the movement of a movable mass may be less than the time period of the downswing. By way of further non-limiting examples, a movable mass may move only during a first portion of the downswing, only during a last portion of the downswing, or even only during an intermediate portion of the downswing. Thus, according to certain aspects, the time period associated with the movement of the movable mass may substantially correspond to the very last portion of the downswing, for example, the last 10 degrees of downswing, when the club head is being squared just prior to impact with the golf ball.

According to further aspects of the disclosure, the one or more movable masses may move due to the effect of gravity. According to even further aspects, movement of the one or more movable masses may be governed by the effect of dynamic centripetal forces experienced by the movable mass during a player's backswing or downswing.

According to other aspects of the disclosure, the one or more movable masses may be releasably restrained from moving. By way of non-limiting examples, a friction fit, a detent, a deformable catch, or even, for example, a magnet may be provided as a catch. By way of non-limiting examples, a release from the catch could occur due: to gravity acting on the movable mass or on the catch; to acceleration other than gravity, such as centripetal loads arising during the player's backswing and/or downswing, acting on the movable mass or on the catch; or to changes in relative geometry between the catch and the movable mass.

Further, the rate of movement of the one or more movable masses may be controlled. By way of non-limiting examples, friction, geometric constraints, cushioning, air pressure, or permeability may be used to control the rate of movement of the one or more movable masses. For example, an aggregate-type movable mass or a liquid-type movable mass may be associated with a flow-restricting container, such that the dynamics of the movable mass may be controlled. Even further, a liquid-type movable mass may be associated with a flow-restricting medium. By way of non-limiting examples, the flow-restricting medium may include a porous medium or a capillary medium. An example of a porous medium may include a sponge-like material.

According to aspects of this disclosure, one or more movable masses may be provided on the shaft of the golf club, on the head of the golf club, or on both. Thus, by way of non-limiting example, a first movable mass may be provided on the shaft and a second movable mass may be provided on the head. Optionally, one or more movable masses may be provided only on the shaft (i.e., without providing any movable mass on the head) or one or more movable masses may be provided only on the head (i.e., without providing any movable mass on the shaft). The first movable mass may be formed with a different mass, different shape, different material, etc. than the second movable mass. Thus, any change in the mass characteristics of the shaft may be decoupled from any change in the mass characteristics of the head. For example, the first movable mass may be flowable, while the second movable mass may be non-deformable.

Thus, according to certain aspects, the one or more movable masses may be provided on the shaft of the golf club for movement along the length of the shaft. By way of non-limiting example, a movable mass may be provided on the outside of the shaft. As another non-limiting example, a movable mass may be provided on the inside of the shaft. During the downswing, the movable mass may move down the shaft, i.e. in a direction from the grip region at the proximal end of the shaft toward the attachment of the shaft to the club head at the distal end of the shaft, under the influence of centrifugal forces and/or gravity forces. The movable mass may move along substantially the entire length of the shaft or, alternatively along only a portion of the length of the shaft. By way of non-limiting example, the movable mass may move only over the length of the shaft that extends from the attachment of the shaft to the club head to approximately halfway up the total length of the shaft.

The one or more movable masses provided on the shaft may include a plurality of movable masses. By way of non-limiting example, a first movable mass may be provided in the upper portion of the shaft for movement between the grip region and approximately the midpoint of the shaft and a second movable mass may be provided in the lower portion of the shaft for movement between approximately the midpoint of the shaft and the attachment to the club head region of the shaft. By way of another non-limiting example, a first movable mass may be provided on the shaft for movement between the grip region and the attachment to the club head region of the shaft and a second movable mass may be provided in the lower portion of the shaft for movement between approximately the midpoint of the shaft and the attachment to the club head region of the shaft.

According to some aspects, the mass of a movable mass provided on the shaft of the golf club may range from approximately 5 grams to approximately 200 grams. More typically, the mass of a movable mass provided on the shaft of the golf club may range from approximately 10 grams to approximately 100 grams. Even more typically, the mass of a movable mass provided on the shaft of the golf club may range from approximately 10 grams to approximately 50 grams. According to other aspects, the mass of a movable mass provided on the shaft may range from 2% to 25% of the mass of the golf club shaft, from 5% to 20% of the mass of the golf club shaft, or from 10% to 15% of the mass of the golf club shaft.

According to certain other aspects, as noted above, the one or more movable masses may be provided on the club head. By way of non-limiting example, a movable mass may be provided on the outside of the club head. As another non-limiting example, a movable mass may be provided on the inside of the club head.

According to particular aspects, during a player's downswing, one or more movable masses may be provided on the club head for movement between the heel of the club head and the toe of the club head. By way of non-limiting example, during the downswing, a movable mass may be configured to move in a direction away from the heel and toward the toe of the club head. When the movable mass is in the heel of the club head, it may help square the face of the club head. Squaring the face for the moment of impact allows for a straighter shot. As the movable mass moves toward the toe, the moment of inertia of the club head increases, thereby increasing the stability of the club head.

The one or more movable masses associated with the club head may move along substantially the entire heel-to-toe length of the club head or, alternatively, along only a portion of the heel-to-toe length of the club head. By way of non-limiting example, a movable mass may move only over portion of the heel-to-toe length of the club that extends from the heel to approximately halfway along the total heel-to-toe length of the club head. As another example, a movable mass may move from the heel of the club head to the center of gravity of the club head.

According to some aspects, the mass of a movable mass provided on the club head of the golf club may range from approximately 5 grams to approximately 100 grams. More typically, the mass of a movable mass provided on the shaft of the golf club may range from approximately 5 grams to approximately 50 grams. Even more typically, the mass of a movable mass provided on the shaft of the golf club may range from approximately 5 grams to approximately 20 grams. According to other aspects, the mass of a movable mass provided on the club head may range from 2% to 25% of the mass of the golf club head (without the mass of the movable weight), from 5% to 20% of the mass of the golf club head, or from 10% to 15% of the mass of the golf club head.

Thus, it is shown that aspects of this disclosure relate to elements that allow for mass characteristics of the golf club to be varied during the downswing. For example, according to particular aspects of the disclosure, the moment-of-inertia and the center-of-gravity of the shaft and/or of the club head may be adjusted during the player's downswing as a function of the centrifugal forces acting on the club during the downswing. Further, particular aspects of the disclosure are directed to the movable masses, themselves, and to the elements developed for controlling the movement of the movable masses.

Additional aspects of this disclosure relate particularly to driver-type golf club structures that incorporate one or more movable masses on the golf club shaft or on the golf club head. Other aspects of this disclosure relate to iron-type golf clubs, such as wedges or putters.

Given the general description of various example aspects of the disclosure provided above, more detailed descriptions of various specific examples of movable masses for golf clubs and the incorporation of the movable masses into the golf club shaft and/or into the golf club head are provided below.

II. Detailed Description of Example Golf Clubs and Devices for Changing the Mass Characteristics of Golf Clubs According to the Disclosure The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

An illustrative embodiment of a golf club 10 is shown in FIG. 1 and includes a shaft 12 and a golf club head 14 attached to the shaft 12. Golf club head 14 may be a driver, as shown in FIG. 1, or other types of gold club heads.

In the example structure of FIG. 1, the club head 14 includes a body member 15 to which the shaft 12 is attached at a hosel or socket 16 in known fashion. The body member 15 includes a plurality of portions, regions or surfaces. The example body member 15 shown in FIG. 1 includes a ball striking face 17, a crown 18, a toe 20, a back 22, a heel 24, a hosel region 26 and a sole 28. As used herein, the term "below" generally refers to the area or direction of the club facing the ground when the club is in the address position. The term "above" generally refers to the area or direction of the club facing away from the ground when the club is in the address position. The "front" of the club generally refers to the area or direction of the club facing the golf ball at the moment of impact. The terms "back" or "rear" as used herein generally refers to the area or direction opposite to the front of the club.

The ball striking face 17 may be essentially flat or it may have a slight curvature or bow (also known as "bulge"). Although the golf ball may contact the ball striking face 17 at any spot on the face, the desired point-of-contact 17*a* is typically approximately centered within the ball striking face 17.

The crown 18, which is located on the upper side of the club head 14, extends from the ball striking face 17 back toward the back 22 of the golf club head 14. The crown 18 extends across the width of the club head 14, from the heel 24 to the toe 20. When the club head 14 is viewed from below, the crown 18 cannot be seen. The sole 28, which is located on the lower or ground side of the club head 14 opposite to the crown 18, extends from the ball striking face 17 back toward the back 22. As with the crown 18, the sole 28 extends across the width of the club head 14 from the heel 24 to the toe 20. When the club head 14 is viewed from above, the sole 28 cannot be seen.

The back 22 is positioned opposite the ball striking face 17, is located between the crown 18 and the sole 28, and extends from the heel 24 to the toe 20. When the club head 14 is viewed from the front, the back 22 cannot be seen. In some golf club head configurations, the back 22 may be provided with a Kammback or other aerodynamic feature.

The heel 24 extends from the ball striking face 17 toward the back 22. When the club head 14 is viewed from the toe side, the heel 24 cannot be seen. Similarly, the toe 20 is shown as extending from the ball striking face 17 toward the back 22 on the side of the club head 14 opposite to the heel 24. When the club head 14 is viewed from the heel side, the toe 20 cannot be seen.

The socket 16, or other element for attaching the shaft 12 to the club head 14, is located within the hosel region 26. The socket 16 may be integrally formed with the club head 14. Optionally, the socket 16 may be separately formed as an element secured to and extending between both the club head 14 and the shaft 12. The hosel region 26 is shown as being located at the intersection of the ball striking face 17, the heel 24, the crown 18 and the sole 28 and may encompass those portions of the heel 24, the crown 18 and the sole 28 that lie adjacent to the socket 16. Generally, the hosel region 26 includes surfaces that provide a smooth transition from the socket 16 to the ball striking face 17, the heel 24, the crown 18 and/or the sole 28.

As used herein, the socket 16 could include an external hosel element for securing the shaft 12 to the body member 15 and/or an internal hosel element for securing the shaft 12 to the body member 15. An internal hosel element may be provided as an integral opening in the top of the body member 15 or as a separate internal hosel member (e.g., an element provided within an interior chamber defined by the body member 15). Optionally, the socket 16 may include both an external portion and an internal portion. Sockets 16 that are separately formed and thereafter engaged to the body member 15 may be secured to the body member 15 by adhesives or cements; by welding, brazing, soldering, or other fusing techniques; by mechanical connectors; etc. Conventional hosels and their inclusion in the club head structure may be used without departing from this disclosure.

Wide varieties of overall club head constructions are possible without departing from this disclosure. For example, if desired, some or all of the various individual regions of the club head 14 described above may be made from multiple pieces that are connected together (e.g., by adhesives or cements; by welding, soldering, brazing, or other fusing techniques; by mechanical connectors; etc.). The various parts (e.g., ball striking face 17, crown 18, sole 28, toe 20, back 22, heel 24, hosel region 26, socket 16, etc.) may be made from any desired materials and combinations of different materials, including materials that are conventionally known and used in the art, such as metal materials, including lightweight metal materials (e.g., titanium, titanium alloys, aluminum, aluminum alloys, magnesium, magnesium alloys, etc., composite materials, polymer materials, etc.). The club head 14 and/or its various regions may be made by forging, casting, molding, and/or using other techniques and processes, including techniques and processes that are conventional and known in the art.

According to some aspects of the disclosure, the golf club head 14 may have a volume between 200-500 cubic centimeters. Typically, a driver-type club head may have a volume between 300 and 500 cubic centimeters. Further, the club head 14 may have a weight between 150 to 800 grams. By way of non-limiting examples, club heads for iron-type and/or wedge-type clubs may have a weight ranging from 300 grams to 800 grams; club heads for driver-type clubs may have a weight ranging from 150 grams to 300 grams.

The golf club shaft 12 includes a proximal end 12*a* and a distal end 12*b*. The player grips the shaft 12 at the proximal end 12*a*. The distal end 12*b* of the golf club shaft 12 may be received in, engaged with, and/or attached to the socket 16 of the club head 14 in any suitable or desired manner, including in conventional manners known and used in the art, without departing from the disclosure. As more specific examples, the golf club shaft 12 may be engaged with the socket 16 of the club head 14 via adhesives, cements, welding, soldering, mechanical connectors (such as threads, retaining elements, or the like), etc. The socket 16 may include an element extending into the club head 14 and/or an element extending into the distal end 12*a* of the shaft 12. If desired, the golf club shaft 12 may be connected to the socket 16 of the club head 14 in a releasable manner using mechanical connectors to allow easy interchange of one shaft 12 for another on the club head 14.

The golf club shaft 12 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. For example, according to some aspects of this disclosure, the shaft 12 may be composed primarily of either steel or graphite. Although steel shafts generally are heavier and may have a lower torque rating than graphite shafts, a steel shaft is generally more durable and resistant to damage than graphite shafts. Conversely, a graphite shaft is generally lighter and has a higher torque rating and torque range available to choose from, depending on the particular graphite selected, than metal shafts. Graphite shafts may have several layers of wound fiber which provide increased rigidity and performance.

Different shafts 12 may be provided with various lengths, diameters, wall thicknesses, material compositions, stiffnesses, flexure properties and other traits and features. Additionally, any given shaft 12 may vary in its particular dimensioning as a function along the length of the shaft. By way of non-limiting example, shaft 12 may be a tapered tube, wherein its outer diameter decreases as the shaft 12 extends from its proximal end 12*a* to its distal end 12*b*. In one example configuration, the shaft 12 may have a diameter of approximately 0.5 inch at its proximal end 12*a*, i.e., near the grip with a continuous taper down the length of the shaft 12. The distal end 12*b*, opposite the proximal end 12*a*, may be the narrowest portion of the shaft 12, having a diameter smaller than the diameter near the grip (e.g., less than 0.5 inches). As another example, shaft 12 may be formed as a tube having a constant inner diameter, but a varying outer diameter.

A grip 13 (or handle member) may be attached to, engaged with, and/or extend from the proximal end 12*a* of the golf club shaft 12 in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member 13 may be integrally formed as a unitary, one-piece construction with the golf club shaft. Additionally, any desired grip or handle member materials may be used consistent with this disclosure, including, for example: rubber materials, leather materials, rubber or other materials including cord or other fabric material embedded therein, polymeric materials, cork materials, and the like.

FIG. 1 schematically illustrates a portion of the golf club shaft 12 cut-away, with an enlarged view showing the details of the cut-away of shaft 12 provided with a movable mass 330. In this particular embodiment, the movable mass 330 is configured to move longitudinally within shaft 12. Additionally, in this particular embodiment, the movable mass 330 is included as part of a movable mass device 300 that is provided within shaft 12. The movable mass device 300 further includes a moveable mass guide 310 configured to guide the movable mass 330 for movement along the length of the shaft 12. In the example embodiment of FIG. 1, the movable mass guide 310 is a slideway formed as a conduit 312 within which the movable mass 330 may travel.

Figure 2:
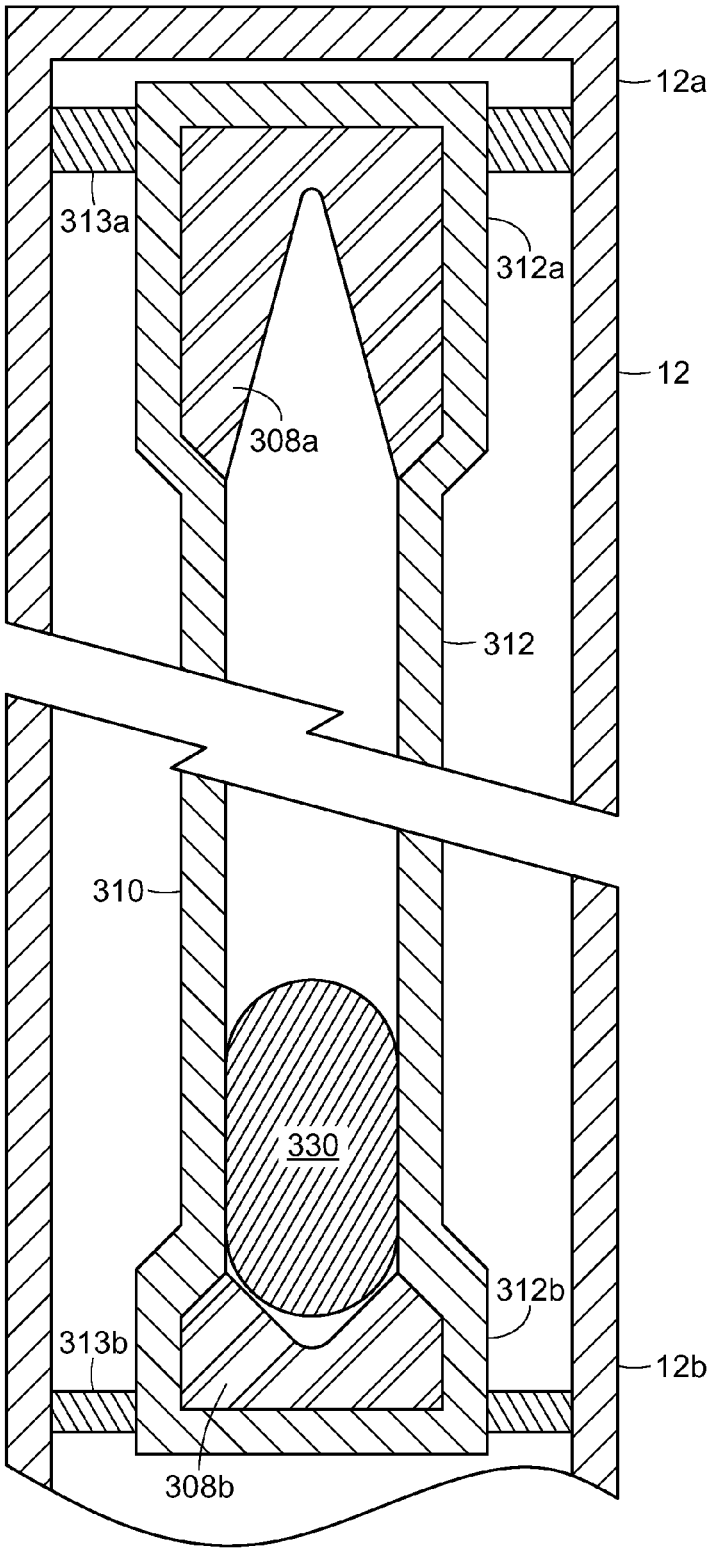
FIG. 2 is a schematic cross-section of golf club shaft having a movable mass located therein according to certain aspects of this disclosure.

The movable mass guide 310 may extend down substantially the entire length of the shaft 12. As best shown in FIG. 2, the conduit 312 may include a proximal end 312*a* and a distal end 312*b*. The proximal end 312*a* of the conduit 312 may be located adjacent the proximal end 12*a* of the shaft 12 and the distal end 312*b* may be located adjacent the distal end 12*b* of the shaft 12. Alternatively, the movable mass guide 310 may extend over only a portion of the longitudinal length of the shaft 12, such as over a majority of the longitudinal length of the shaft 12. Thus, by way of non-limiting example, the movable mass guide 310 may extend over greater than half of the length of the shaft 12. For example, the movable mass guide 310 may extend over approximately two-thirds of the length of the shaft 12 or even over approximately three-quarters of the length of the shaft 12. As another example, the movable mass guide 310 may extend from approximately a midpoint 12*c* of the shaft 12 to the distal end 12*b* of the shaft 12. By way of a further non-limiting example, the movable mass guide 310 may extend over a minor portion of the longitudinal length of the shaft 12. For example, the movable mass guide 310 may extend from the distal end 12*b* of the shaft 12 toward the proximal end 12*a* of the shaft 12 over 10%, 20%, 30% or even 40% of the length of the shaft 12.

Figure 3A:
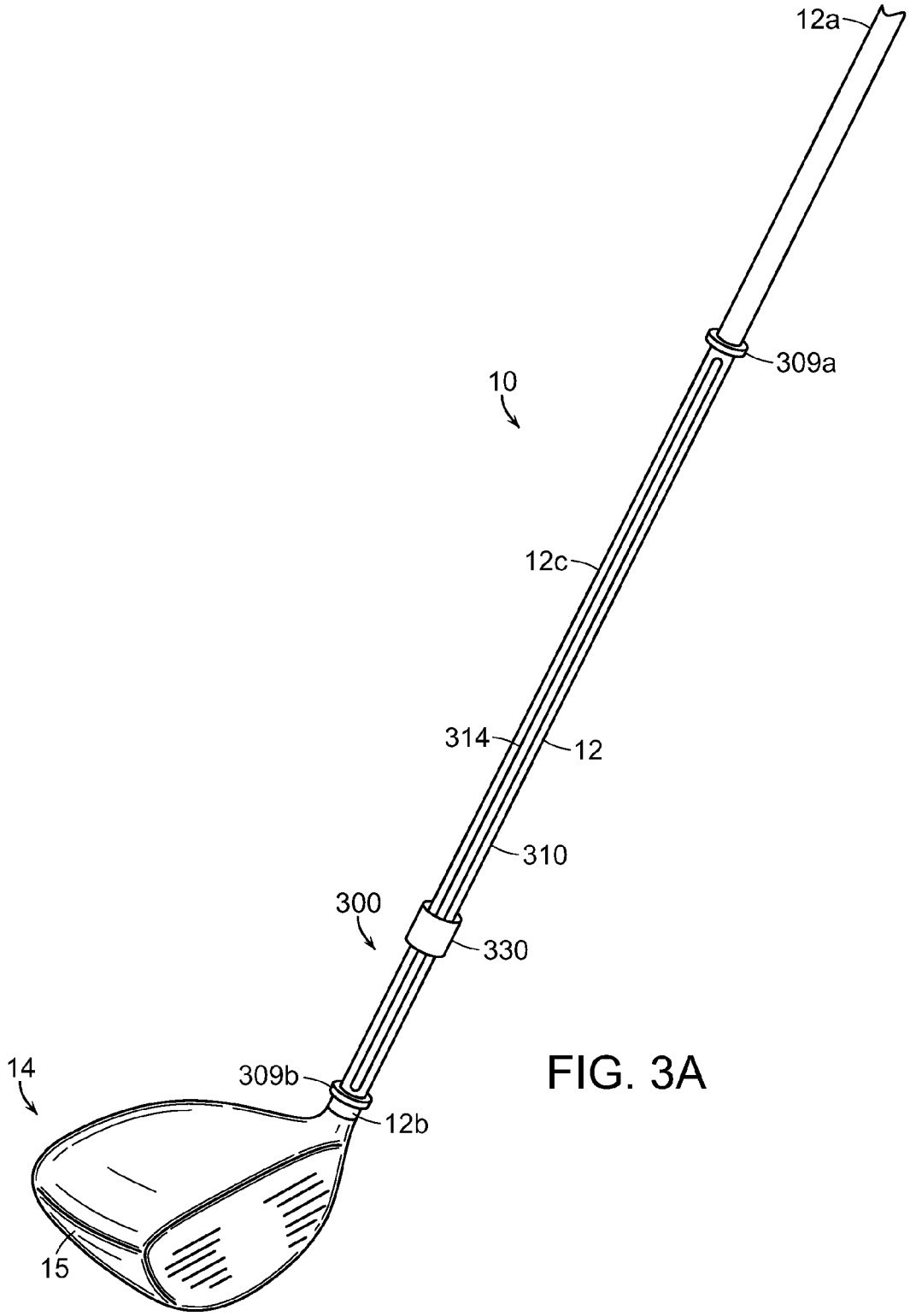
FIGS. 3A and 3B generally illustrate perspective views of a golf club structure according to other aspects of this disclosure.
Figure 3B:
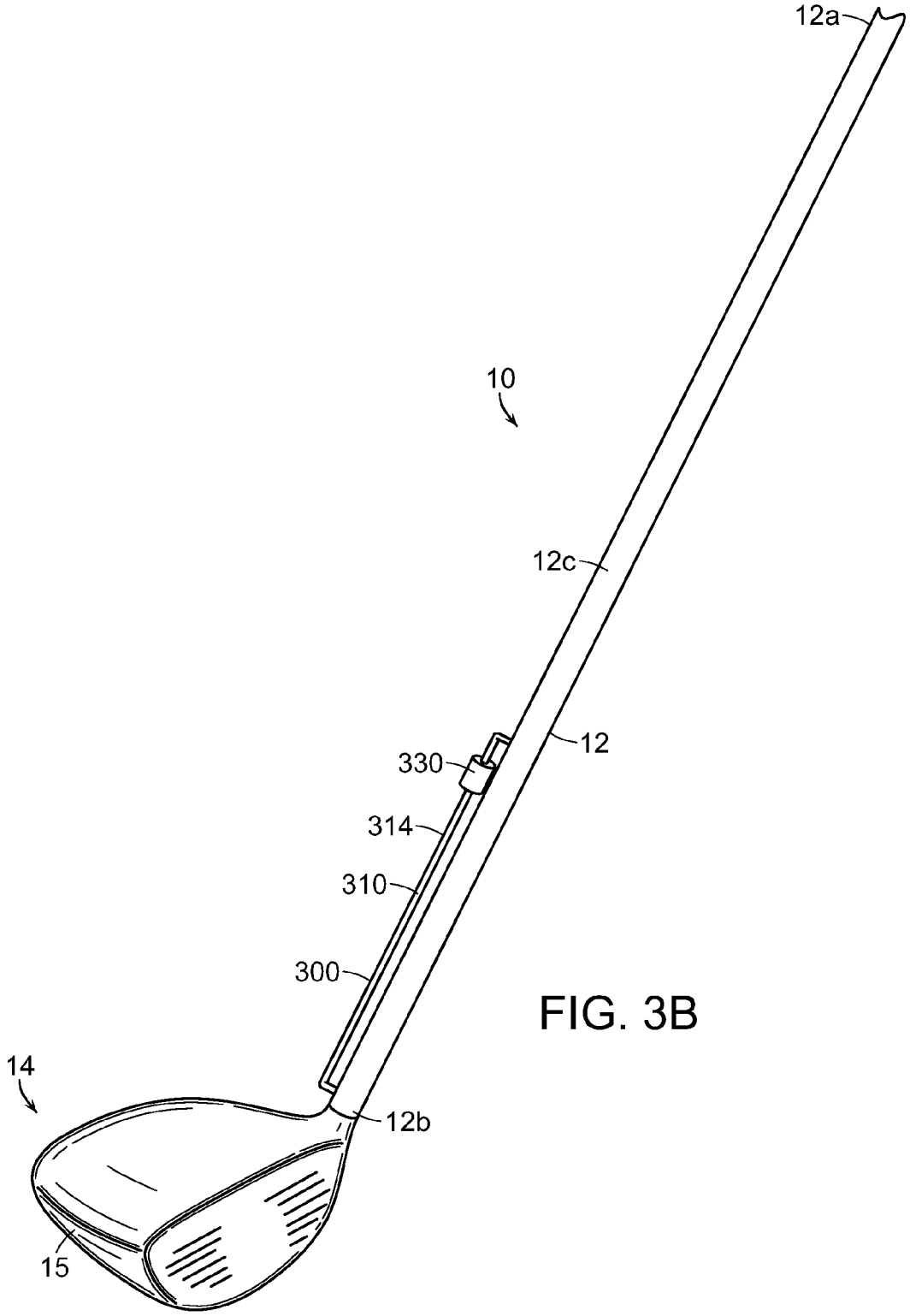

According to certain aspects, the movable mass 330 may be located entirely within the shaft 12, as shown in FIGS. 1 and 2. According to other aspects, for example, as shown in FIGS. 3A and 3B, a movable mass 330 may be located external to the shaft 12.

Figure 4:
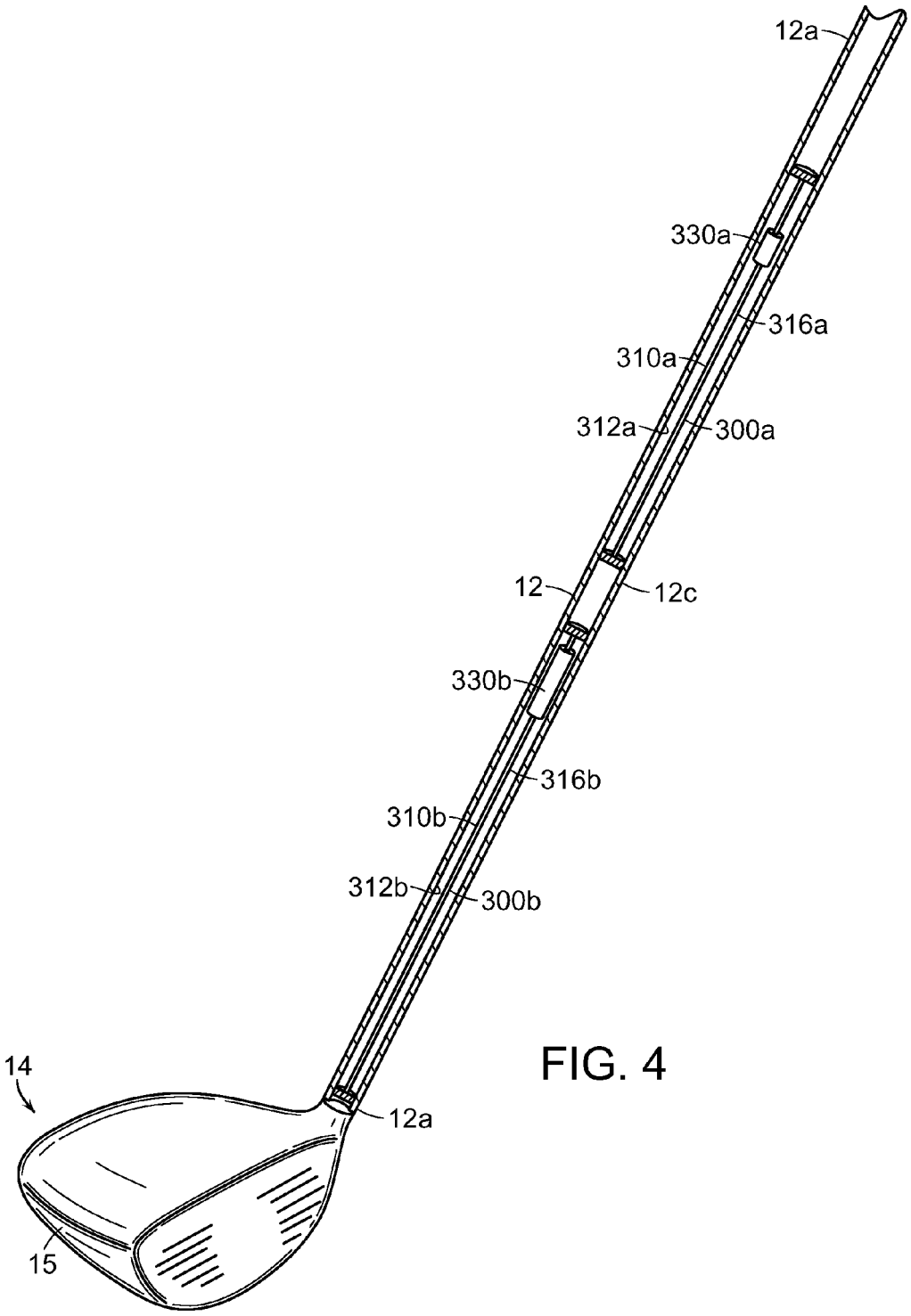
FIG. 4 generally illustrates a perspective view of a golf club structure, with a cut-away view of the golf club shaft, according to even other aspects of this disclosure.
Figure 5B:
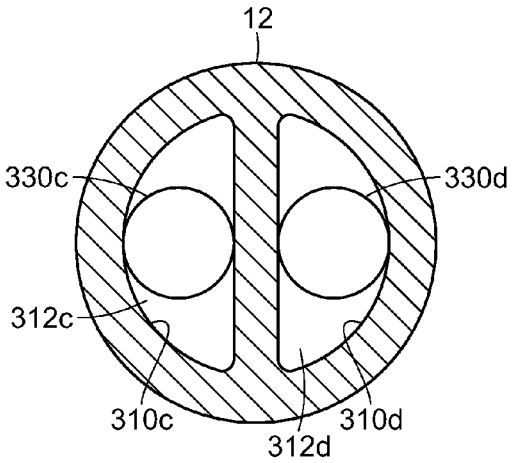
FIG. 5B is a transverse cross-section view of the golf club shaft of FIG. 5A.
Figure 5A:
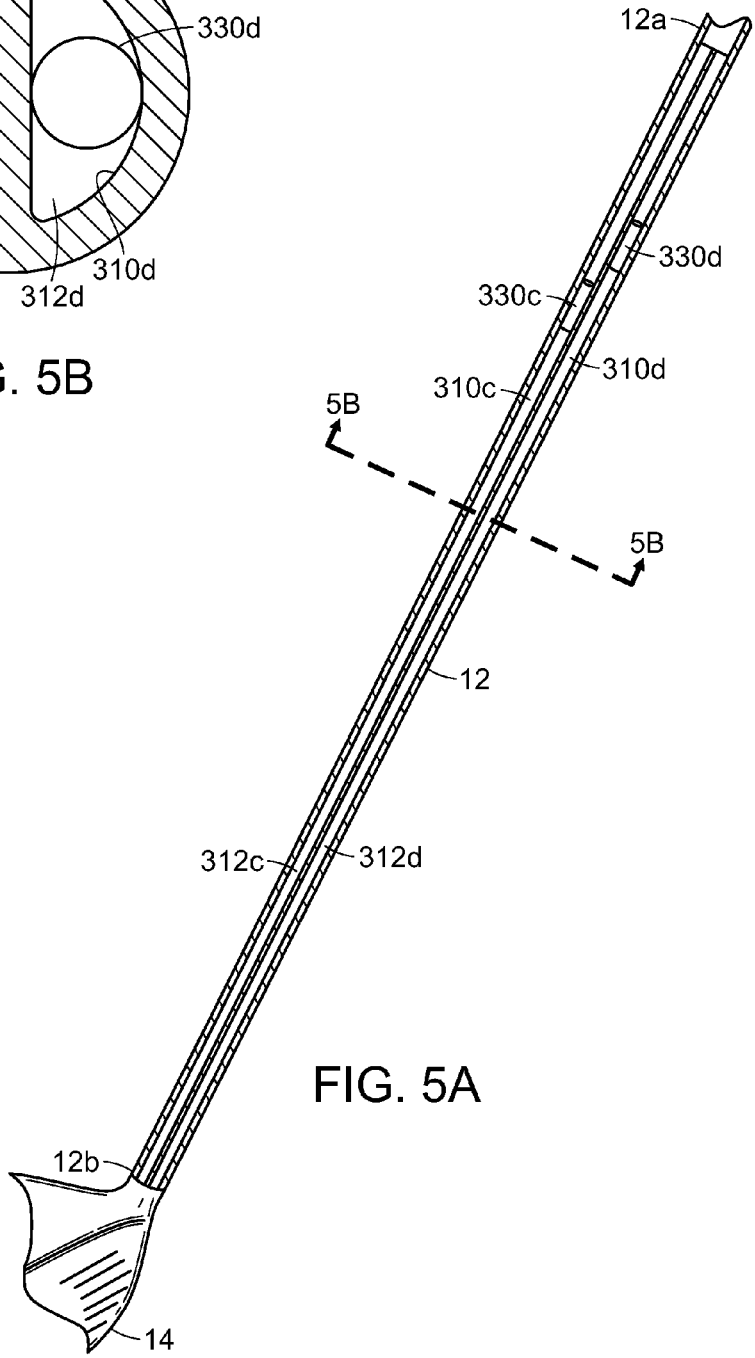
FIG. 5A is a longitudinal cross-sectional view of a golf club shaft having a plurality of movable masses located therein according to some aspects of this disclosure.

Even further, more than one movable mass 330 may be located within or external to the shaft 12. Thus, by way of non-limiting example, as shown in FIG. 4, a first movable mass 330*a* within movable mass guide 310*a* may be located in the proximal half of the shaft 12, while a second movable mass 330*b* within movable mass guide 310*b* may be located in the distal half of the shaft 12. By way of another non-limiting example, movable mass guides 310*c*, 310*d* may extend parallel to one another, with at least a portion of their lengths overlapping. Thus, as shown in FIG. 5A, in one example configuration, the movable masses 330*c*, 330*d* may be provided within the movable mass guides 310*c*, 310*d*, which extend side-by-side over substantially the entire length of the shaft 12. Specifically, as best shown in FIG. 5B, the tubular bore of shaft 12 may be diametrically divided into two conduits 312*c*, 312*d* with movable masses 330*c*, 330*d* slidably located therein, respectively. Other suitable configurations for the movable mass guides would be apparent to persons of ordinary skill in the art given the benefit of this disclosure.

According to certain aspects, the movable mass guide 310 may be formed as a separate element from the shaft 12. Subsequently, the movable mass guide 310 may be engaged with, and/or attached to, the shaft 12 using any suitable or desired manner, including conventional manners known and used in the art, without departing from the disclosure. As more specific examples, the movable mass guide 310 may be engaged with the shaft 12 via adhesives, cements, welding, soldering, mechanical connectors (such as threads, retaining elements, or the like), etc.; through guide-receiving sleeve or other support elements extending within the shaft 12; etc. Thus, for example, the conduit 312 of FIG. 1 and/or the conduit 312 of FIG. 2 may be connected to a shaft 12 (or supported within the shaft 12) at one or both ends 312*a*, 312*b* of the conduit 312 (see, e.g. conduit supports 313*a*, 313*b* in FIG. 2), at one or more discrete locations between the proximal and distal ends 312*a*, 312*b* (see, e.g., conduit support 313*c* in FIG. 1), or continuously over the length (or portions of the length) of the conduit 312.

According to other aspects, the movable mass guide 310 may be integrally formed with the shaft 12. Thus, by way of non-limiting example as shown in FIG. 4, the inner wall of shaft 12 (in the upper portion of the shaft 12) provides a conduit 312*a* through which movable mass 330*a* moves. Further, the inner wall of shaft 12 (in the lower portion of the shaft 12) provides a conduit 312*b* through which the movable mass 330*b* may slide, roll or otherwise travel. Alternatively, only a portion of the wall of the conduit 312 may be coextensive with a portion of the wall of the shaft 12. Thus, by way of non-limiting example, the wall or a portion of a wall of the conduit 312 may be coextensive with the wall or a portion of the wall of the shaft 12. As shown in FIGS. 5A and 5B, a portion of the wall of the conduit 312*c* is coextensive with an arcuate section of the inner wall of shaft 12 over substantially the entire length of the shaft 12. Similarly, a portion of the wall of the conduit 312*d* is coextensive with an arcuate section of the inner wall of shaft 12 over substantially the entire length of the shaft 12. In another example configuration (not shown) an arcuate portion of an inner wall of the conduit 312 may be coextensive with an arcuate portion of the outer wall of the shaft 12.

As with the golf club shaft 12, the movable mass conduit 312 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. For example, according to some aspects of this disclosure, the movable mass conduit 312 may be composed of a polymeric material.

As would be apparent to persons of ordinary skill in the art, given the benefit of this disclosure, a movable mass conduit 312 need not be any particular cross-sectional area or shape, length, material composition, stiffness, etc. Thus, for example, the movable mass guide 310 may be a conduit 312 having any of various cross-sections, including circular, square, oval, hexagonal, pie-shaped, ring-shaped, etc. Alternatively, the movable mass guide 310 may be a conduit 312 having an irregularly shaped cross-section.

According to certain aspects, the movable mass device 300 or the movable mass guide 310 need not include a conduit 312. Referring to the embodiment of FIG. 3A, for example, the movable mass 330 is configured as a cylindrical element slidably located on the exterior of the shaft 12. In this embodiment, the exterior surface of the shaft 12 provides the movable mass guide 310. Stops 309*a*, 309*b* may be provided at the proximal and distal ends of the movable mass guide 310. The stops 309*a*, 309*b* may be formed as elastomeric bumpers or rings designed to stop travel of the movable mass 330 and at the same time attenuate impact loads experienced when the movable mass 330 contacts the stop. Further, a track-like element 314 for guiding movable mass 330 may be provided as part of the movable mass guide 310 on the exterior surface of the shaft 12. Thus, according to other aspects, the movable mass guide 310 may include one or more relatively stiff, track-like elements 314, e.g., a rail, a rod, etc. Referring to the example embodiment of FIG. 3B, the movable mass 330 is slidably located on the track-like element 314, which is attached to the outside of the shaft 12. In this example embodiment, the track-like element 314 is provided as a thin rod which extends through a central bore in the movable mass 330 and which is bent at its ends for attachment to the outer surface of the shaft 12.

As even another example, as shown in FIG. 4, the movable mass guide 310 may be formed as one or more flexible, strand-like elements 316, e.g., compliant wires, filaments, cables, etc. The movable mass 330 may slide along the length of the flexible, strand element 316. Referring to another example embodiment as shown in FIG. 4, the movable masses 330*a*, 330*b* are slidably located on the strand-like elements 316*a*, 316*b*, respectively. In this example embodiment, the strand-like elements 316*a*, 316*b* are formed as thick wires extending between two plug-like elements that are secured to the inside walls of the shaft 12. The movable masses 330*a*, 330*b* are provided with a central bore through which the strand-like elements 316*a*, 316*b* extend. In this example embodiment, any slight lateral motion of the movable masses 330*a*, 330*b* may be restrained by the conduits 312*a*, 312*b*.

As compared to a conduit 312, which may contact the movable mass 330 along an entire cross-sectional peripheral surface of the movable mass 330, a track-like element 314 or a flexible element 316, generally may contact the movable mass 330 along a more limited portion of the cross-sectional surface. Thus, the flexible elements 316 or the stiffer, track-like elements 314 may provide a relative low-friction movable mass guide 310 as compared to a conduit 312.

Figure 6:
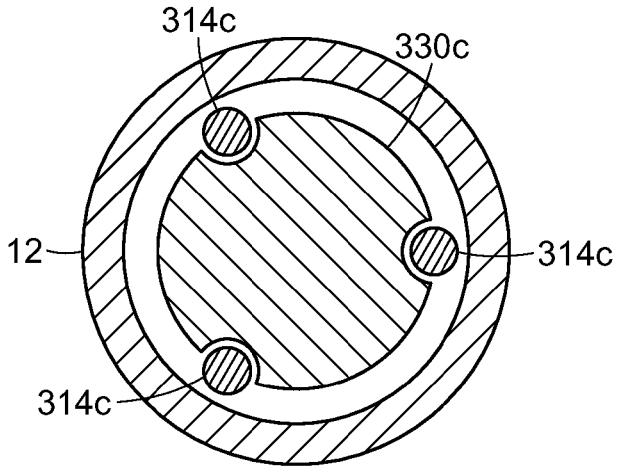
FIG. 6 is a transverse cross-section view of a golf club shaft according to other aspects of this disclosure.
Figure 7:
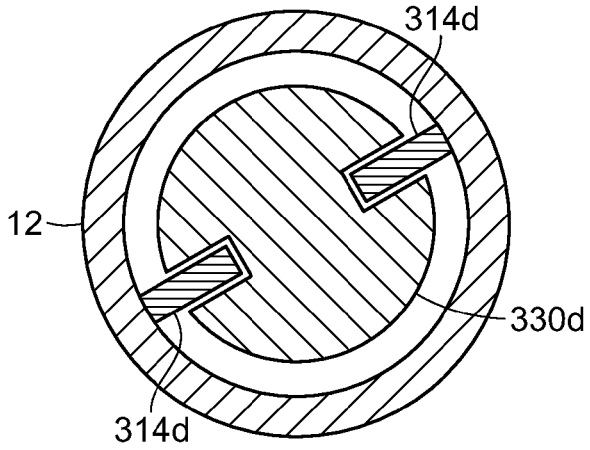
FIG. 7 is a transverse cross-section view of a golf club shaft according to even other aspects of this disclosure.

By way of non-limiting examples, FIGS. 6 and 7 illustrate other various configurations for movable mass guides 310. For example, FIG. 6 illustrates a set of three track-like elements 314*c* that extend longitudinally along at least a portion of the length of the shaft 12. These three track-like elements 314*c* are provided as rods that contact the movable mass 330*c* at points spaced circumferentially 120 degrees apart. At each contact point of a rod with the movable mass 330*c*, the movable mass 330*c* is provide with a slight indentation that complements the cross-section of the rods. As another example, FIG. 7 illustrates a set of two track-like elements 314*d* that extend longitudinally along at least a portion of the length of the shaft 12. These two track-like elements 314*d* are provided as fins that contact the movable mass 330*d* at points spaced circumferentially 180 degrees apart. At each contact point of the fins with the movable mass 330*d*, the movable mass 330*d* is provide with a slot that receives an edge of a fin. As would be apparent to persons of ordinary skill in the art, given the benefit of this disclosure, other configurations of movable mass guides 310 may also be suitable.

The physical characteristics of a movable mass guide 310 need not be constant along its length. For example, as shown in FIG. 2, one or more of the ends of the movable mass guide 310 may be enlarged to accommodate a resilient element 308. The resilient element 308 may provide a cushion to slow the movable mass 330 right before and as the movable mass 330 reaches the end of its travel, thereby reducing impact loads and sounds. In one aspect, the resilient element 308 may act as a "soft stop." The resilient element 308 may be provided as a spring, an elastomeric pad, etc. Further, the resilient element 308 may be shaped to capture or retain movable mass 330. Thus, as shown at the proximal end 12*a* of the shaft 12, the resilient element 308*a* may be formed with a relatively soft, foam material having a conically-shaped bore that allows movable mass 330 to become lodged within resilient element 308*a*. The capture of movable mass 330 by resilient element 308*a* may be overcome, i.e., movable mass 330 may be released, due to the action of gravity or dynamic forces developed during a downswing. As another example (not shown), the cross-section of the conduit 312 may decrease at one or both of its ends 312*a*, 312*b*. The decreasing cross-section at the ends may provide an increased friction force on the movable mass 330, thereby causing the movable mass 330 to slow down and eventually stop. The change in cross-sectional area, if any, may occur abruptly or gradually.

According to aspects noted above, one or more movable masses 330 may be provided within or associated with one or more movable mass guides 310. The movable mass 330 may be non-deformable, as shown in FIG. 1. Non-deformable movable masses 330 may be made from any desired materials and combinations of different materials, including materials that are conventionally known and used in the art, such as metal materials, including, but not limited to, relatively high density materials (e.g., steel, lead alloys, lead alloys, etc.), composite materials, polymer materials, ceramics, glasses, etc. Such a movable mass 330 may be made by forging, casting, molding, and/or using other techniques and processes, including techniques and processes that are conventional and known in the art.

Alternatively, the movable mass 330 may be a deformable mass. For purposes of this disclosure, a deformable mass 330 may be categorized as either flowable or non-flowable.

In general, a flowable deformable mass 330 has no predefined shape, but rather assumes the shape of the vessel that contains. By way of non-limiting examples, a flowable mass 330 may include non-solids, such as a liquid, a paste, or a gelatin. As another example, a flowable mass 330 may include solids, such as beads or fine particles forming, in the aggregate, a flowable material. Water, with a relatively low-viscosity, may be suitable. Liquid with higher viscosities, such as glycerol or certain oils, may also be suitable. Optionally, as another example, a flowable mass 330 may include a combination of particulates and liquid.

Figure 8B:
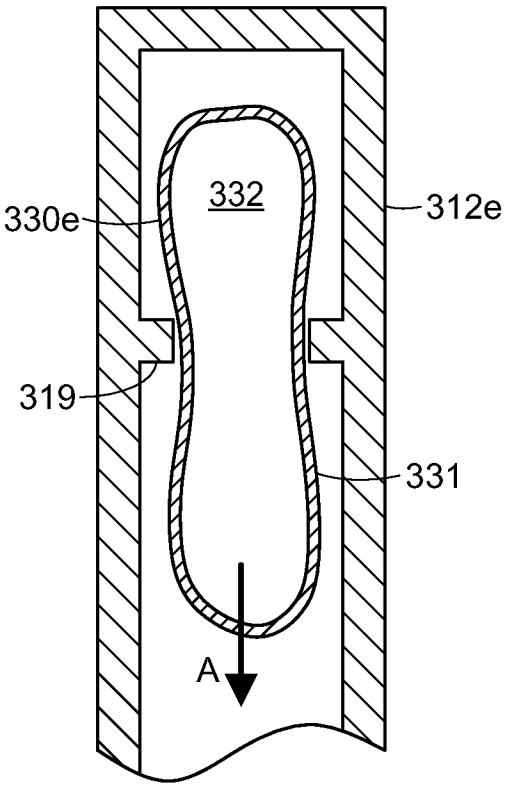
FIGS. 8A and 8B illustrate a longitudinal cross-section view of a portion of a conduit with a deformable movable mass located therein according to further aspects of this disclosure.
Figure 8A:
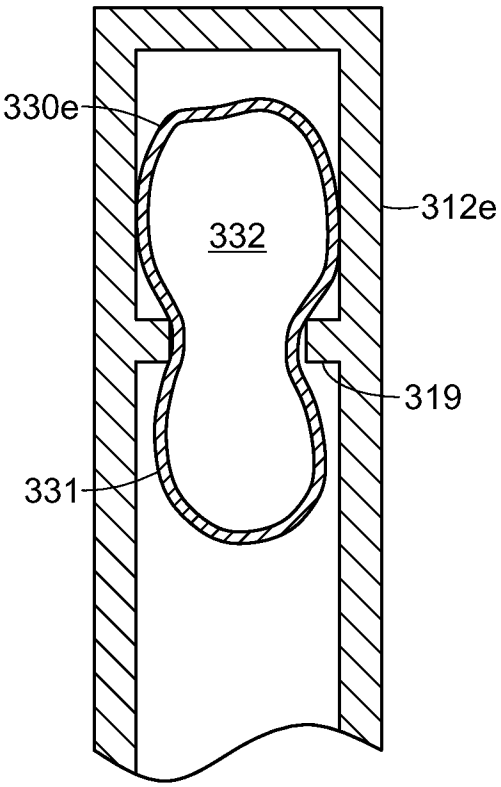

On the other hand, a non-flowable deformable mass 330 has a predefined shape when no forces are acting on it, but may assume a different shape when subjected to external forces. Referring to FIGS. 8A and 8B, as a non-limiting example, a non-flowable deformable mass 330 may include a flexible external member or skin 331 surrounding a flowable material 332. Thus, as an example, a non-flowable deformable mass 330 could be formed as a liquid-filled elastomeric capsule. As another example, a non-flowable deformable mass 330 could be formed as a gelatin- or paste-filled elastomeric capsule. As even another example, a non-flowable deformable mass 330 may be formed as an elastomeric capsule containing glass or polymeric beads or other material that is flowable in the aggregate. In these examples, the external skin 331 surrounds the flowable material 332 such that the flowable material is contained.

According to certain aspects, a deformable movable mass 330 may be advantageous. For example, as shown in FIGS. 8A and 8B, a deformable movable mass 330*e* may be provided in a conduit 312*e* having a constriction 319 (i.e., a reduced inner dimension). The constriction 319, which may be formed integrally with the conduit 312 as shown in FIGS. 8A and 8B, may function as a catch or restraining mechanism. In other words, under certain circumstances, the constriction 319 may restrict the movement of the movable mass 330. The constriction 319 may optionally be formed from an elastomeric material that deforms to allow passage of at least a portion of the movable mass 330 or that provides a gripping force on the movable mass. Under the application of gravity, with the club in any orientation, the deformable movable mass 330*e* may be wedged or fitted within the conduit 312*e* at the constriction 319 (see FIG. 8A). However, upon the application of the dynamic centrifugal forces experienced during a downswing, the deformable movable mass 330*e* may elongate along the line of forces, e.g., in the longitudinal direction 'A'. This elongation in the longitudinal direction could be accompanied by a corresponding decrease in the cross section of the deformable movable mass 330*e* (see FIG. 8B), such that under certain dynamic forces the deformable movable mass 330*e* could be released to slide within the conduit 312*e*.

According to some aspects of the disclosure, the movable mass 330 may be provided with a low friction surface over some, or all, of its surface. Such a low friction surface may enable the movable mass 330 to more readily travel down the length of the movable mass guide 310. Low friction surfaces may be achieved by polishing, plating, coating or other techniques and processes that are conventional and known in the art.

Figure 9:
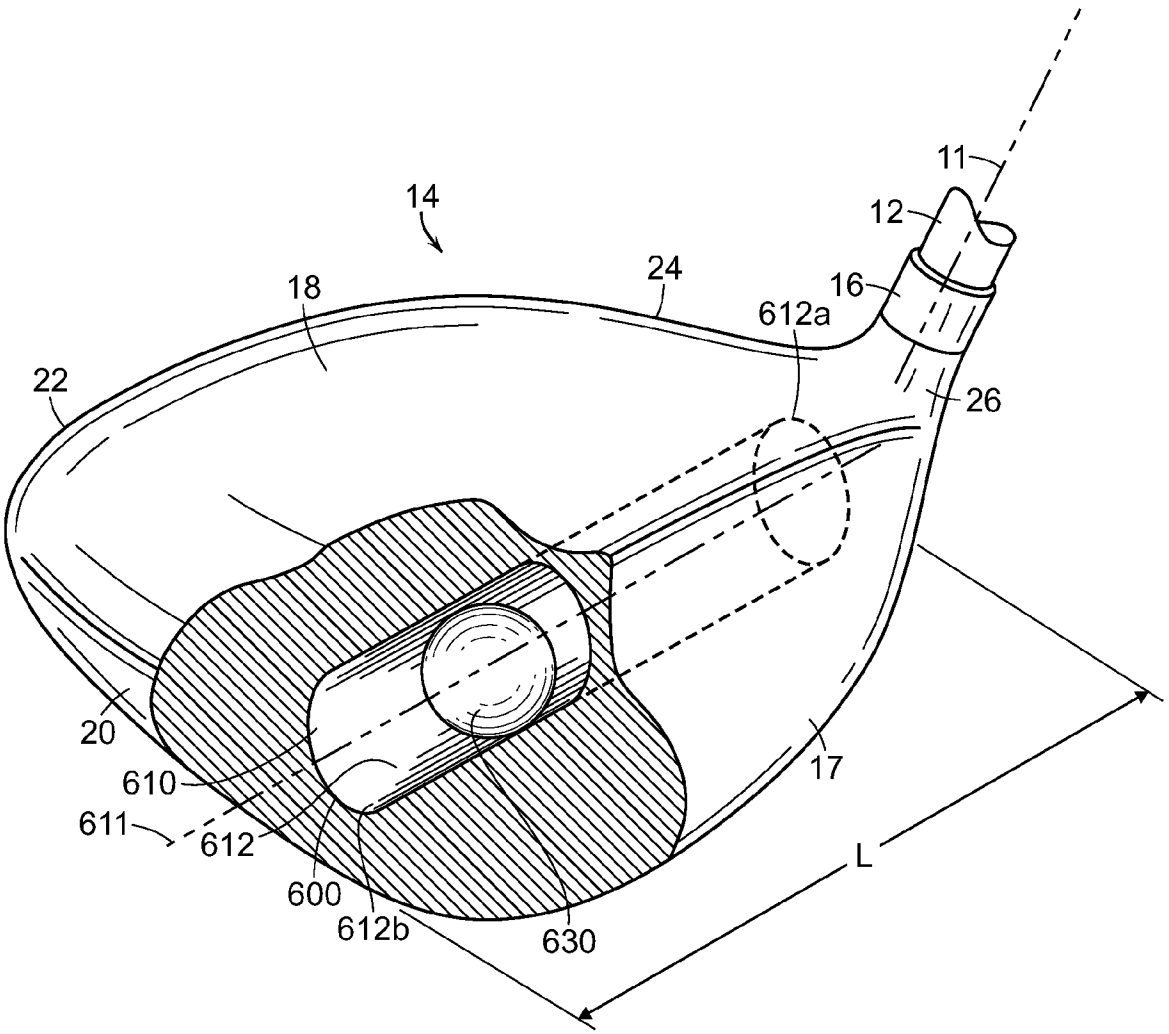
FIG. 9 generally illustrates a perspective view of a golf club structure, with a cut-away view of the golf club head, according to other aspects of this disclosure.

According to certain aspects, a movable mass may be associated with the club head 14. Thus, for example, FIG. 9 schematically illustrates the golf club head 14 with a portion of the club head at the intersection of the face 17 and the toe 20 cut-away to show a movable mass device 600. The movable mass device 600 is shown with a movable mass 630 configured for sliding and/or rolling within a movable mass guide 610. In the example embodiment of FIG. 9, the movable mass guide 610 is a slideway formed as a conduit 612 within which the movable mass 630 may travel.

In this particular embodiment, a centerline 611 of the movable mass device 600 and the movable mass guide 610 is aligned approximately parallel to a vertical plane defined by the longitudinal axis 11 of the shaft 12 positioned a 60 degree lie angle (see, USGA Rules and Procedures). Thus, if a heel-to-toe axis of the face 17 of the club head 14 is approximately aligned with the 60 degree lie angle vertical plane, the movable mass 630 may move approximately parallel to the face 17 of the club head 14 between the heel 24 and the toe 20. The centerline 611 of the movable mass device 600 may be positioned between the face 17 and the back 22 of the club head 14. Thus, as one example, the centerline 611 of the movable mass device 600 may be located within ±0.50 cm of the longitudinal axis of the shaft 12. Optionally, the centerline 611 of the movable mass device 600 may be located from 0.00 cm to 3.50 cm, from 0.00 cm to 2.50 cm, or even from 0.00 cm to 1.50 cm, rearwardly from the longitudinal axis of the shaft 12. Further, in this particular embodiment, the movable mass guide 610 is aligned approximately parallel to the ground (when the club 10 is in its 60 degree lie angle position). The centerline 611 of the movable mass device 600 may be located within ±1.50 cm, within ±1.00 cm or even within ±0.50 cm of the horizontal plane including the center-of-gravity of the club head 14.

The movable mass device 600 may extend substantially over the entire length 'L' of the club head 14. The club head length 'L' (i.e., the heel-to-toe length) may be determined as provided in USGA "Procedure for Measuring the Club Head Size of Wood Clubs." As best shown in FIG. 9, the conduit 612 may include a heel end 612*a* and a toe end 612*b*. The heel end 612*a* of the conduit 612 may be located adjacent the heel 24 of the club head 14 and the toe end 612*b* may be located adjacent the toe 20 of the club head 14. Alternatively, the movable mass guide 610 may extend over only a portion of the club head length of the club head 14. Thus, by way of non-limiting example, the movable mass guide 610 may extend over greater than half of the club head length of the club head 14. For example, the movable mass guide 610 may extend over approximately two-thirds of the club head length of the club head 14 or even over approximately three-quarters of the club head length of the club head 14. By way of further non-limiting examples, even a small shift in the center-of-gravity of the club head may be advantageous, and the movable mass guide 610 may extend from the heel 24 of the club head 14 toward the toe 20 of the club head 14 over 10%, 20%, 30% or even 40% of the club head length of the club head 14. Further, optionally, the movable mass guide 610 may be configured such that at the end of its travel during the course of a downswing, a center-of-gravity of the movable mass 630 may be positioned behind the desired point-of contact 17*a* of the face 17 of the club head 14 with the golf ball. In other words, at the end of its travel, the movable mass 630 may be aligned (along a trajectory direction of the golf club head) with the point-of-contact 17*a* of the striking face 17.

Figure 10:
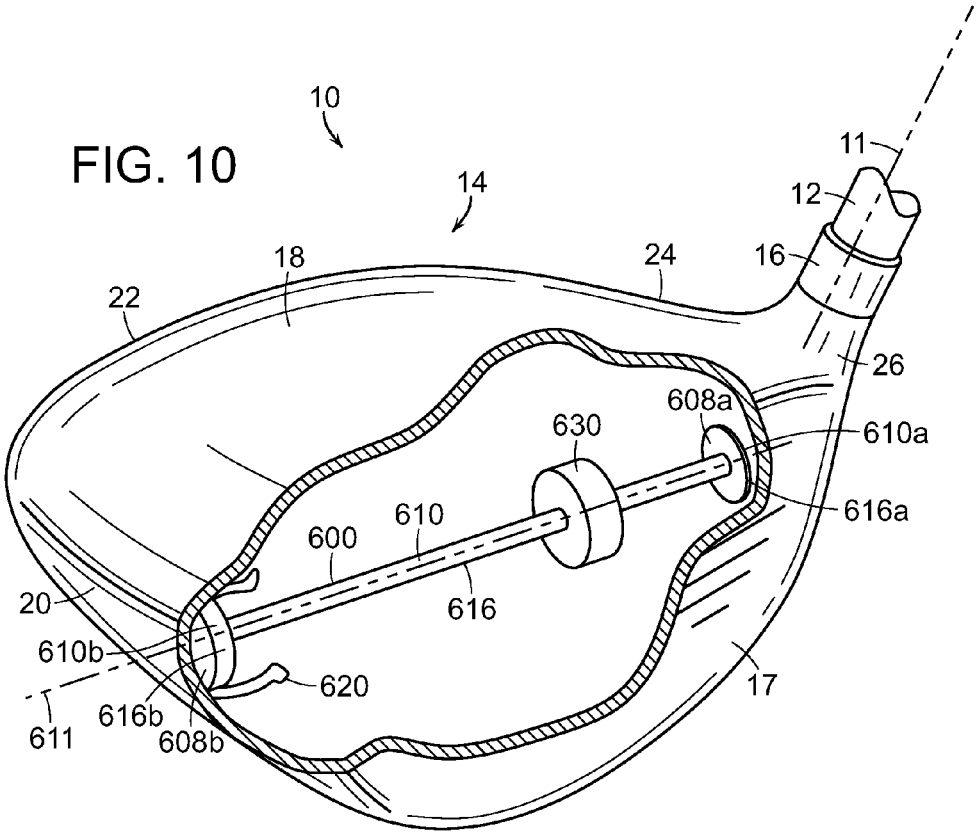
FIG. 10 generally illustrates a perspective view of a golf club structure, with a cut-away view of the golf club head, according to even other aspects of this disclosure.

According to another aspect, FIG. 10 schematically illustrates the golf club head 14 with a portion of the club head at the intersection of the face 17 and the crown 18 cut-away to show a movable mass device 600. The movable mass device 600 in this embodiment is shown with a movable mass 630 configured for sliding along a movable mass guide 610. In the example embodiment of FIG. 10, the movable mass guide 610 is a slideway formed as a flexible element 616 on which the movable mass 630 may travel. Flexible element 616 is shown as being attached at end 616*a* to an inner surface of the heel 24 and attached at end 616*b* to an inner surface of the toe 20. In this particular embodiment, flexible element 616 is a relatively thick wire. However, in this embodiment, the flexible element 616, although coupled to the club head 14, does not significantly change the stiffness characteristics of the club head 14. In other words, the stiffness of the flexible element is much less (possibly orders of magnitude less) than the stiffness of the club head 14. In alternative embodiments (not shown), for example, in which the slideway is formed as a track-like element, the stiffness characteristics of the club head may be changed due to the stiffness of the slideway.

In the particular embodiment of FIG. 10, the movable mass device 600 with the movable mass guide 610 are illustrated as being slightly angled to the vertical plane of the longitudinal axis 11 of the shaft 12 (i.e., from the 60 degree lie angle vertical plane), with the heel-side end 610*a* of the movable mass guide 610 being closer to the face 17 than the toe-side end 610*b*. By way on non-limiting example, the movable mass guide 610 may be angled from 2 degrees to 45 degrees from the 60 degree lie angle vertical plane. It is expected that more typically, the movable mass guide 610 may be angled from 2 degrees to 30 degrees, from 5 degrees to 25 degrees, or even from 5 degrees to 15 degrees from the 60 degree lie angle vertical plane. Further, in this particular embodiment, the movable mass guide 610 is slightly angled from the horizontal plane (i.e., from the horizontal when the club is in the 60 degree lie angle position). The heel-side end 610*a* is shown as being slightly higher than the toe-side end 610*a*. It is expected that the movable mass guide 610 may be angled from 2 degrees to 30 degrees, from 5 degrees to 25 degrees, or even, more typically, from 5 degrees to 15 degrees from the 60 degree lie angle horizontal plane. Thus, in the configuration of FIG. 10, the movable mass 630 is configured to move slightly toward the back 22 and slightly toward the sole 28 as it travels from the heel-side end 610*a* toward the toe-side end 610*b*.

Alternatively (not shown), the movable mass device 600 with the movable mass guide 610 may be slightly angled to the vertical plane of the longitudinal axis 11 of the shaft 12 (i.e., from the 60 degree lie angle vertical plane) with the heel-side end 610*a* of the movable mass guide 610 being farther away from the face 17 than the toe-side end 610*b*. As even another alternative (also not shown), the movable mass guide 610 may be slightly angle from the horizontal plane (when the club is in the 60 degree lie angle position), with the heel-side end 610*a* being slightly lower than the toe-side end 610*a*. Even further, the movable mass device 600 need not have a linear movable mass guide 610. For example (not shown), the movable mass guide 610 may be curved such that as the mass 630 travels from the heel-side toward the toe-side, it initially travels toward the back and then towards the face of the club head.

At either end of the movable mass device 600, i.e. at either end of movable mass guide 610, one or more control-type elements may be provided. For example, referring to FIG. 10, elastomeric element 608*a*, 608*b* may be provided to cushion the impact of the movable mass 630 as it comes to the end of its travel at the ends of the flexible element 616. Further, at the toe-side end 616*b* of the flexible element 616, a catch element 620 may be provided. Catch element 620 is shown as a plurality of elongated, flexible fingers configured to flex radially outwardly to thereby allow movable mass 630 to reach the end 616*b*. Once the movable mass 630 is captured by the catch element 620, the catch element 620 may restrain movable mass 630 from moving back toward heel-side end 616*a* until a predetermined release force is reached (for example, due to gravitational loads).

Figure 11:
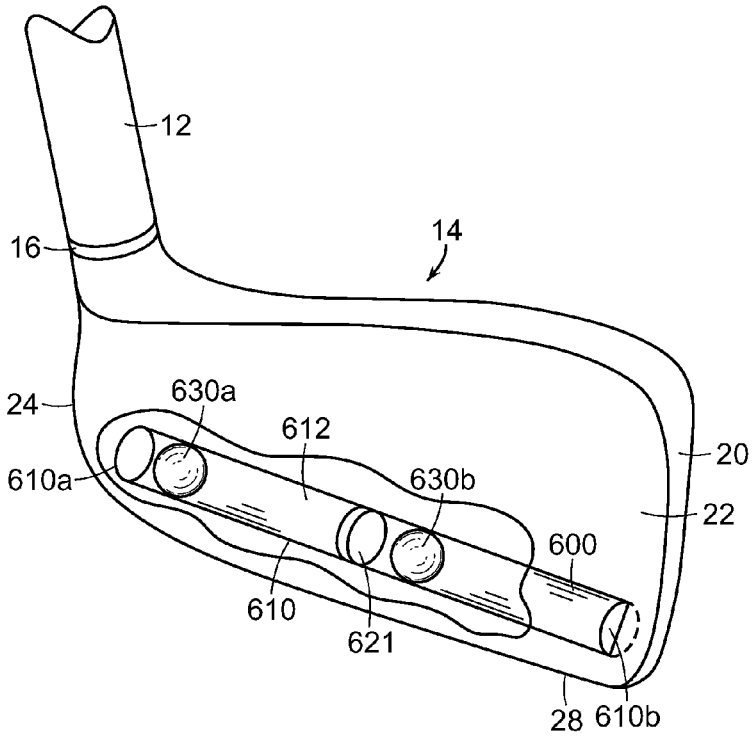
FIG. 11 generally illustrates a perspective view of a golf club structure, showing the back of an iron-type club head with a cut-away view of a movable mass device, according to further aspects of this disclosure.

According to certain aspects, the movable mass device 600 may be located entirely within the club head 14, as shown in FIGS. 9 and 10. According to other aspects, as shown in FIG. 11, a movable mass device 600 may be located, at least partially, on the exterior of a club head 14. In the embodiment of FIG. 11, the club head 14 is an iron-type club head, such as a wedge or putter.

Even further, more than one movable mass 630 may be located within or external to the club head 14. Thus, by way of non-limiting example, as shown in FIG. 11, a first movable mass 630*a* within movable mass guide 610 may be located in the heel portion of the club head 14, while a second movable mass 630*b* within movable mass guide 610 may be located in the toe portion of the club head 14. In the embodiment of FIG. 11, a control-type element such as stop 621 is provided within movable mass guide 610. The stop 621 essentially prevents the movable masses 630*a*, 630*b* from travelling past a midpoint of the movable mass guide 610. Other suitable configurations for the movable mass guides would be apparent to persons of ordinary skill in the art given the benefit of this disclosure.

According to even other aspects, the movable mass device 600 may be formed as a separate element from the club head 14. For example, as shown in FIG. 11, the movable mass device 600 may be formed as a self-contained, cylindrical unit including the movable mass guide 610, the movable masses 630*a*, 630*b*, and the stop 621. Further as shown in FIG. 11, this self-contained movable mass device 600 may be partially inset into the back wall of the club head 14. The self-contained cylindrical unit may be secured (either removably or permanently) to club head 14 using any suitable or desired manner, including conventional manners known and used in the art, without departing from the disclosure. Removably securing the self-contained movable mass guide 600 to the club head 14 would allow a player to customize the dynamic mass characteristics of the club head.

According to other aspects, as better shown for example in FIG. 9, the movable mass guide 610 may be integrally formed with the club head 14. Thus, by way of non-limiting example, a bore extending through a solid portion of club head 14 may proved a conduit 612 through which movable mass 630 moves.

As described above with respect to movable mass 330, the movable mass 630 may be a non-deformable mass or a deformable mass. The deformable mass 630 may be categorized as either flowable or non-flowable.

In light of the above disclosure, it is understood that golf clubs may be provided with a device for dynamically changing a mass characteristic of the golf clubs. The mass-characteristic-changing device may include one or more movable masses that may move during a backswing and/or during a downswing due to gravitational and/or centripetal forces. Further, the mass-characteristic-changing device may include a moveable mass guide configured to guide the one or more movable masses as they move. The device may be located in and/or on the shaft of the golf club and/or in and/or on the head of the golf club.

Therefore, as fully disclosed herein, one or more movable masses may be provided on the shaft of the golf club, on the head of the golf club, or on both. A person of ordinary skill in the art would understand that a first movable mass may be provided on the shaft and a second movable mass may be provided on the head. Optionally, one or more movable masses may be provided only on the shaft (i.e., without providing any movable mass on the head) or one or more movable masses may be provided only on the head (i.e., without providing any movable mass on the shaft). The first movable mass may be formed with a different mass, different shape, different material, etc. than the second movable mass. Thus, a person of ordinary skill in the art would understand, given the benefit of this disclosure, that one of the advantages disclosed herein is that the dynamic change in the mass characteristics of the shaft may be decoupled from any dynamic change in the mass characteristics of the head.

III. Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims.

For example, while driver-type (e.g., wood-type) golf clubs are discussed in detail above, this is not intended to suggest that iron-type golf clubs are outside the scope of this disclosure. On the contrary, iron-type golf clubs such as, iron-type hybrid clubs, driving irons, 0 through 10 irons, wedges (e.g., pitching wedges, lob wedges, gap wedges, sand wedges, etc.), chipping clubs, etc. are included within the scope of this disclosure. Such iron-type golf clubs may include an iron-type club head body that has a ball striking face portion, a rear portion opposite the ball striking face, a crown (or top) portion, a sole portion, a toe end portion and a heel end portion.

We claim:

1. A device for changing the mass characteristics of a golf club, the golf club having a golf club shaft extending longitudinally from a proximal end to a distal end and a golf club head attached to the distal end of the golf club shaft, the device comprising:

a movable mass;

a movable mass guide provided within the golf club shaft, the movable mass guide configured to accommodate longitudinal travel of the movable mass; and a resilient element located at a distal end of the movable mass guide, wherein the resilient element attenuates impact loads and sounds when the movable mass reaches the distal end of the movable mass guide; and wherein the resilient element is shaped having a conically-shaped bore that allows the moveable mass to become lodged with the resilient element, wherein the movable mass guide does not extend beyond the distal end of the golf club shaft.

2. The device according to claim 1, wherein the movable mass guide accommodates travel of the movable mass within the golf club shaft.

3. The device according to claim 1, wherein the movable mass is non-deformable.

4. The device according to claim 1, further includes a second resilient element located at a proximal end of the movable mass guide, wherein the second resilient element attenuates impact loads and sounds when the movable mass reaches the proximal end of the movable mass guide.

5. The device according to claim 1, wherein the movable mass guide extends over a majority of the length of the golf club shaft.

6. The device according to claim 1, wherein, during a downswing of the golf club, the movable mass travels longitudinally along at least a portion of the movable mass guide.

7. A golf club comprising:

a golf club shaft extending longitudinally from a proximal end to a distal end;

a golf club head attached to the distal end of the golf club shaft; and the device according to claim 1.

* * * * *